US009288853B2

(12) United States Patent
Yu

(10) Patent No.: US 9,288,853 B2
(45) Date of Patent: Mar. 15, 2016

(54) LED DRIVING CIRCUIT AND LED DRIVING CONTROLLER

(75) Inventor: Chung-Che Yu, New Taipei (TW)

(73) Assignee: GREEN SOLUTION TECHNOLOGY CO., LTD., New Taipei (TW)

( * ) Notice: Subject to any disclaimer, the term of this patent is extended or adjusted under 35 U.S.C. 154(b) by 404 days.

(21) Appl. No.: 13/354,343

(22) Filed: Jan. 20, 2012

(65) Prior Publication Data

US 2012/0235570 A1 Sep. 20, 2012

(30) Foreign Application Priority Data

Mar. 17, 2011 (TW) ..... 100109227 A

(51) Int. Cl.
*H05B 37/00* (2006.01)
*H05B 33/08* (2006.01)

(52) U.S. Cl.
CPC ..... *H05B 33/0815* (2013.01); *H05B 33/0848* (2013.01)

(58) Field of Classification Search
CPC ..... H05B 33/0815; H05B 33/0818; H05B 33/0827; H05B 33/0845; H05B 33/0824; H05B 33/089; H05B 33/0848; H05B 33/0851; H05B 33/0887; H05B 37/0263; H05B 33/0803; H05B 33/0836; H05B 33/0842
USPC ..... 315/121, 224, 294, 307
See application file for complete search history.

(56) References Cited

U.S. PATENT DOCUMENTS

| | | | | |
|---|---|---|---|---|
| 7,538,534 | B2 | 5/2009 | Mednik et al. | |
| 7,928,670 | B2 | 4/2011 | Chen et al. | |
| 8,227,998 | B2 * | 7/2012 | Liu et al. | 315/247 |
| 8,228,001 | B2 | 7/2012 | Fan | |
| 2006/0072324 | A1 | 4/2006 | Hachiya et al. | |
| 2008/0150436 | A1 * | 6/2008 | Suzuki | 315/169.3 |
| 2009/0302774 | A1 | 12/2009 | Mednik et al. | |
| 2010/0207536 | A1 * | 8/2010 | Burdalski et al. | 315/224 |
| 2011/0037414 | A1 | 2/2011 | Wang et al. | |
| 2011/0285685 | A1 * | 11/2011 | Naito et al. | 345/211 |
| 2012/0133295 | A1 * | 5/2012 | Pereira et al. | 315/210 |

FOREIGN PATENT DOCUMENTS

| | | |
|---|---|---|
| CN | 1623269 | 6/2005 |
| CN | 1964587 | 5/2007 |
| CN | 101155446 | 4/2008 |

(Continued)

OTHER PUBLICATIONS

"Office Action of China Counterpart Application", issued on Dec. 4, 2013, p. 1-p. 10.

(Continued)

*Primary Examiner* — Douglas W Owens
*Assistant Examiner* — Monica C King
(74) *Attorney, Agent, or Firm* — Jianq Chyun IP Office

(57) ABSTRACT

The present invention discloses an LED driving circuit and controller, capable of maintaining an average value of a current flowing through an LED module at a predetermined current value. The LED driving circuit and controller compensates influences of any factors deviating the average value of the current flowing through the LED module by modulating a period of constant on time or constant off time, or by modulating the determining value(s) of current peak value and/or current valley value according to a difference between an actual average value and the preset current value.

9 Claims, 2 Drawing Sheets

(56) References Cited

FOREIGN PATENT DOCUMENTS

| | | |
|---|---|---|
| CN | 101621876 | 1/2010 |
| WO | 2010118944 | 10/2010 |

OTHER PUBLICATIONS

"Office Action of China Counterpart Application", issued on Jul. 9, 2014, p. 1-p. 9.

* cited by examiner

LED DRIVING CIRCUIT AND LED DRIVING CONTROLLER

CROSS-REFERENCE TO RELATED APPLICATION

This application claims the priority benefit of Taiwan application serial no. 100109227, filed on Mar. 17, 2011. The entirety of the above-mentioned patent application is hereby incorporated by reference herein and made a part of this specification.

BACKGROUND OF THE INVENTION (1) Field of the Invention

This invention relates to an LED driving circuit and an LED driving controller.

(2) Description of the Prior Art

FIG. 1 is a circuit diagram of a typical LED driving circuit. The LED driving circuit includes an inductance L, a transistor switch M1, a flywheel unit M2, an LED module 20, a current detecting resistance Ri and a controller 10. The controller 10 controls the transistor switch M1 to be turned on/off by means of constant off-time control, so as to drive the LED module 20 lighting. The description of the detailed circuit operation is as following.

The controller 10 includes a comparator 2, a SR flip-flop 6 and a constant off-time unit 4. A non-inverting end of the comparator 2 receives a reference signal Vr and an inverting end thereof is coupled to the current detecting resistance Ri to receive a current detecting signal IFB. At the beginning of each cycle, the transistor switch M1 is turned on and so an increasing current supplied by an input power source Vin flows through the inductance L, the LED module 20 to be grounded. When a level of the current detecting signal IFB is higher than that of the reference signal Vr, the comparator 2 generates a high-level signal to a set end S of the SR flip-flop 6. Therefore, the SR flip-flop 6 is triggered to output a low-level signal at an inverting output end Q' to cut the transistor switch M1 off. Afterward, the current flowing through the LED module 20 freewheels through the flywheel unit M2, and an output end Q of the SR flip-flop 6 generates a high-level signal to the constant off-time unit 4. After a predetermined off-time period, the constant off-time unit 4 generates a pulse signal to a reset end R of the SR flip-flop 6, and so the SR flip-flop 6 generates a high-level signal at the inverting output end Q' to turn on the transistor switch M1 again for the next cycle.

In theory, the current of the LED module 20 is vibrated between a current peak value and a current valley value. However, the current valley value depends on the predetermined cut-off time period, and varies with a voltage of the input power source Vin. It results that an average value of the current is changed due to the input power source Vin, as same as an illumination and a color-temperature of the LED module 20. Even the actual current peak value of the current the LED module 20 also varies because of time delay in circuit operation and the process error in the inductance value of the inductance L.

SUMMARY OF THE INVENTION

As mentioned above, the typical constant off time controller is utilized for driving the LED. The average value of current varies with the input voltage, the inductance value and etc. The LED driving circuit and the LED driving controller in the present invention adjust a determining level of the current peak/valley value or a constant on/off time period according to the actual average value of current and the predetermined current value, and so a deviation in the average value of current can be compensated to correct the average value of current to the predetermined current value.

To accomplish the aforementioned and other objects, the embodiment of the invention provides an LED driving circuit. The LED driving circuit comprises an LED module, an inductance, a flywheel unit, a switch module and an LED driving controller. The inductance is coupled to one end of the LED module. The flywheel unit is coupled to the LED module and the inductance for providing a current loop. The switch module is coupled to the LED module and controls a power from the input power source whether to supply to the LED module or not. The LED driving controller is utilized for cyclically turning the switch module on or off for a predetermined time period in response to a current detecting signal representing an amount of a current flowing through the LED module, wherein the predetermined time period is adjusted according to the current detecting signal to substantially stabilize an average value of the current flowing through the LED module at a predetermined current value.

The embodiment of the invention also provides an LED driving controller, utilized for controlling a switching converter circuit to supply a driving power to an LED module. The LED driving controller comprises a comparator unit, a switch control unit and a current corrective unit. The comparator unit generates a comparison result signal according to a current detecting signal representing an amount of a current flowing through the LED module. The switch control unit generates a switch control signal according to the comparison result signal and a predetermined time period to control a switch module of the switching converter circuit. The current corrective unit generates a current corrective signal in response to the current detecting signal to adjust the predetermined time period, thereby stabilizing an average value of the current flowing through the LED module at a predetermined current value.

The embodiment of the invention still also provides an LED driving controller, utilized for controlling a switching converter circuit to supply a driving power to an LED module. The LED driving controller comprises a hysteresis comparator unit, a switch control unit and a current corrective unit. The current corrective unit generates at least a reference signal according to a current detecting signal representing an amount of a current flowing through the LED module. The hysteresis comparator unit generates a comparison result signal according to the current detecting signal and the least a reference signal. The switch control unit generates a switch control signal in response to the comparison result signal to control a switch module of the switching converter circuit.

BRIEF DESCRIPTION OF THE DRAWINGS

The present invention will now be specified with reference to its preferred embodiment illustrated in the drawings, in which.

DESCRIPTION OF THE PREFERRED EMBODIMENT

Figure 1:
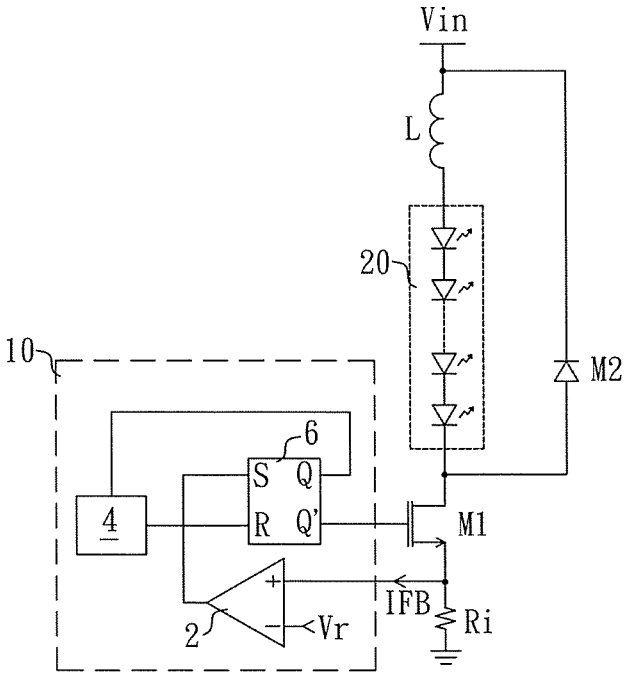
FIG. 1 (PRIOR ART)
FIG. 1 is a circuit diagram of a typical LED driving circuit.
Figure 2:
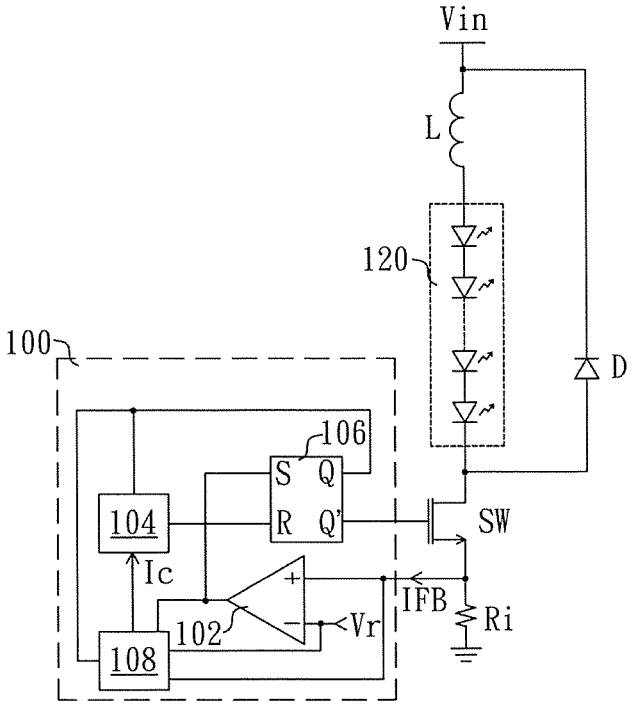
FIG. 2 is a circuit diagram of an LED driving circuit in accordance with a first exemplary embodiment of the present invention.

FIG. 2 is a circuit diagram of an LED driving circuit in accordance with a first exemplary embodiment of the present invention. The LED driving circuit comprises a switching converter circuit and an LED driving controller 100. The LED driving controller 100 controls the switching converter circuit to supply a driving power to an LED module 120. The switching converter circuit includes an inductance L, a switch module SW and a flywheel unit D. One end of the inductance L is coupled to an input power source Vin, the other end thereof is coupled to a positive end of the LED module 120. One end of the switch module SW is coupled to a negative end of the LED module 120, and another end of the switch module SW is coupled to the ground. A positive end of the flywheel unit D is coupled to the negative end of the LED module 120, and a negative end of the flywheel unit D is coupled to the input power source Vin to provide a freewheeling current loop for a current of the inductance L.

In the present embodiment, the LED driving controller 100 is a constant off time controller, comprising a comparator unit 102, a SR flip-flop 106, a constant off time unit 104, a switch control unit and a current corrective unit 108. A current detecting resistance Ri is coupled to the switch module SW and generates a current detecting signal IFB representing an amount of a current of the LED module 120 during the period of the switch module SW being turned on. The comparator unit 102 generates a comparison result signal according to the current detecting signal IFB and a reference signal Vr, which represents a predetermined current value. A set end S of the SR flip-flop 106 is coupled to an output end of the comparator unit 102, a reset end R and an output end Q thereof are coupled to the constant off time unit 104, and an inverting output end Q' is coupled to a controlled end of the switch module SW. At the beginning of each cycle, the LED driving controller 100 turns the switch module SW on and so an increasing current from the input power source Vin flows through the inductance L, the LED module 120, the switch module SW, the current detecting resistance Ri to ground. When the current increases to have a level of the current detecting signal IFB be higher than a level of the reference signal Vr, the comparator unit 102 generates a high-level signal to the SR flip-flop 106. Then, the SR flip-flop 106 turns off the switch module SW and triggers the constant off time unit 104 to start counting time. The constant off time unit 104 generates a pulse signal to reset the SR flip-flop 106 when counting a predetermined time period, so that the SR flip-flop 106 turns on the switch module SW again for next cycle. The predetermined time period depends on an application circuit. An applicable predetermined time period is to operate the inductance L operates in the continuous current mode, i.e., the current of the inductance L is still above the zero current when the switch module SW is turned off.

The current corrective unit 108 determines a difference between a predetermined current value and an average value of the current, which is calculated according to the current detecting signal IFB, and accordingly generates a current corrective signal Ic to adjust the predetermined time period of the constant off time unit 104. Thereby, the average value of the current flowing through the LED module 120 is substantially stabilized at the predetermined current value. In the present embodiment, the current detecting resistance Ri detects the current only when the switch module SW is turned on. The current corrective unit 108 is coupled to the comparator unit 102 and the SR flip-flop 106, and determines a turned-on timing of the switch module SW. During that the switch module SW is turned on, the current corrective unit 108 determines whether the difference of the average value of the current and the predetermined current according to the current detecting signal IFB and the reference signal. If there is the difference, the current corrective unit 108 adjusts the predetermined time period. For example, when the average value of the current value is higher than the predetermined current value, the current corrective unit 108 lengthens the predetermined time period until that the average value is equal to the predetermined current value. On the other hand, when the average value is lower than the predetermined current value, the current corrective unit 108 shortens the predetermined time period until that the current average value is equal to the predetermined current value. Thus, the LED driving circuit of the present invention can be applicable for the full voltage range of 90-264V and has an advantage of compensating process errors of components and time delay in circuit operation resulted in deviation of the average value of the current flowing through the LED module 120.

The embodiment mentioned above detects the peak value of the current and determines the period of the off time of the switch module according to the average value of the current to ensure that the current flowing through the LED module is within a suitable operation range and further the life spin of the LED module is extended. Of course, the present invention can alternatively detects a valley value of the current and determine a period of an on time of the switch module according to the average value of the current. The detailed description is described below.

Figure 3:
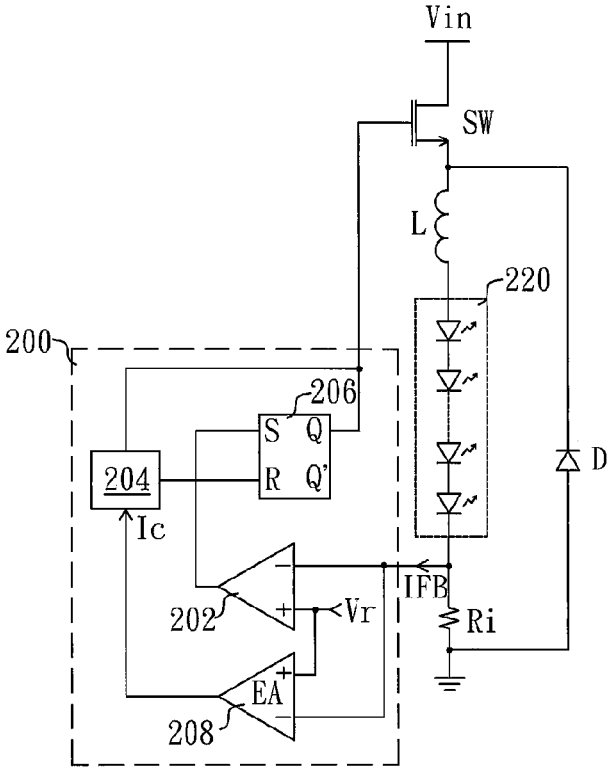
FIG. 3 is a circuit diagram of an LED driving circuit in accordance with a second exemplary embodiment of the present invention.

FIG. 3 is a block diagram showing the LED driving circuit in accordance with a second exemplary embodiment of the present invention. The LED driving circuit includes a switching converter circuit and an LED driving controller 200. The LED driving controller 200 controls the switching converter circuit to supply a driving power to an LED module 220. The switching converter circuit comprises an inductance L, a switch module SW and a flywheel unit D. One end of the switch module SW is coupled to an input power source Vin, and the other end thereof is couple to one end of the inductance L. The other end of the inductance L is coupled to a positive end of the LED module 220, and a negative end of the LED module 220 is coupled to the ground through a current detecting resistance Ri. A positive of the flywheel unit D is coupled to the negative end of the LED module 220, and a negative end of the flywheel unit D is coupled to a node between the inductance L and the switch module SW to supply the current of the inductance L a freewheeling path.

In the present embodiment, the LED driving controller 200 is a constant on time controller, comprising a comparator unit 202, a SR flip-flop 206, a constant on time unit 204 and a current corrective unit 208. Compared with the embodiment shown in FIG. 2, the present embodiment can detect a current of the LED module 220 when the switch module SW is turned on and turned off, i.e., full time. Thus, the LED driving controller 200 exactly determines the average value of the current flowing through the LED module 220. The comparator unit 202 generates a comparison result signal according to the current detecting signal IFB generated by the current detecting resistance Ri and a reference signal Vr. A set end S of the SR flip-flop 206 is coupled to an output end of the comparator unit 202, an output end Q thereof is coupled to the constant on time unit 204 and a controlled end of the switch module SW, a reset end R thereof is coupled to an output end of the constant on time unit 204. At the beginning of each cycle, the current of the LED module 220 is lower and so the comparator unit 202 generates a high-level signal. Therefore, the RS flip-flop 206 generates a high-level signal at the output end Q to turn the switch module SW on and so an increasing current from the input power source Vin flows through the switch module SW, the inductance L, the LED module 220, the current detecting resistance Ri to ground. The constant on time unit 204 starts counting time when receiving the high-level signal of the output end Q of the SR flip-flop 206. The constant on time unit 204 generates a pulse signal to reset the RS flip-flop 206 after counting the predetermined time period. At this time, the SR flip-flop 206 cuts the switch module SW off and then the current of the inductance L freewheels through the flywheel unit D. When the current lowers to cause the comparator unit 202 to generate the high-level signal, the switch module SW is turned on again for next cycle. The current of the inductance L all keeps above a current valley value (represented by the reference signal Vr), so that the inductance L is operated in the continuous current mode.

In the present embodiment, the current corrective unit 208 is an error amplifier, which receives the current detecting signal IFB and the reference signal Vr for determining a difference of the average value of the current and the predetermined current value. Accordingly, the current corrective unit 208 generates a current corrective signal Ic to adjust the predetermined time period of the constant on time unit 204. When the average value is higher than the predetermined current value, the current corrective unit 208 shortens the predetermined time period until that the average value is equal to the predetermined current value. On the other hand, when the average value is lower than the predetermined current value, the current corrective unit 208 lengthens the predetermined time period until that the current average value is equal to the predetermined current value. Thus, any factor of influencing the current can be dynamically compensated and so the average value of the current flowing through the LED module 220 is substantially stabilized at the predetermined current value.

Figure 4:
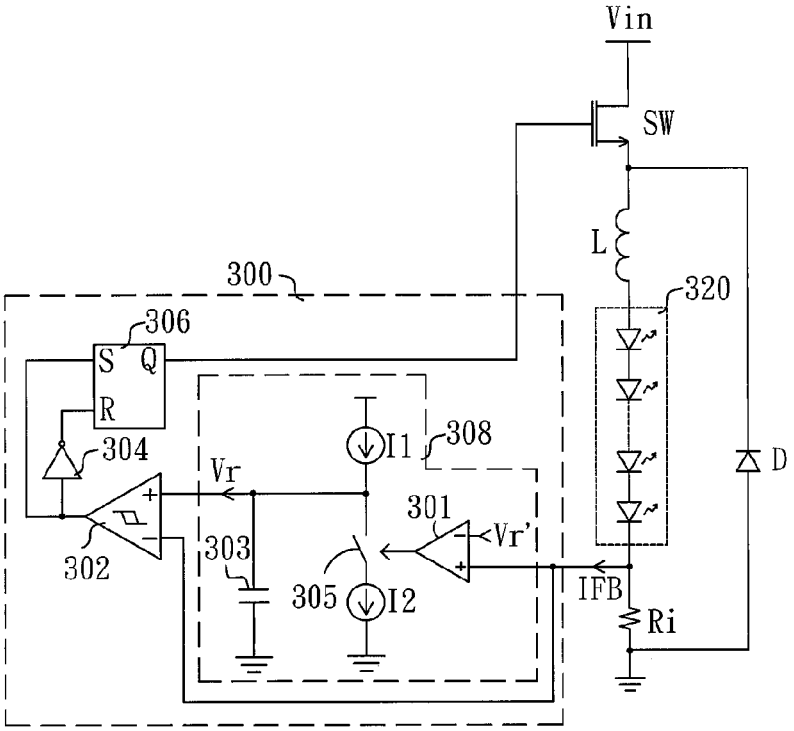
FIG. 4 is a circuit diagram of an LED driving circuit in accordance with a third exemplary embodiment of the present invention.

The two embodiments mentioned above illustrate that the present invention is applied to the LED driving circuits with the constant off time control (for detecting the current peak value) and the constant on time control (for detecting the current valley value). Besides, the present invention can be applied to a LED driving circuit with a ripple mode control, which detects both the peak and valley value of the current of the LED module to control the switch module. FIG. 4 is a circuit diagram showing the LED driving circuit in accordance with a third exemplary embodiment of the present invention. The LED driving circuit comprises a switching converter circuit and an LED driving controller 300. The LED driving controller 300 controls the switching converter circuit to supply a driving power to an LED module 320. The switching converter circuit includes an inductance L, a switch module SW and a flywheel unit D. One end of the switch module SW is coupled to an input power source Vin, and another end of the switch module SW is coupled to one end of the inductance L. The other end of the inductance L is coupled to a positive end of the LED module 320. A negative end of the LED module 320 is coupled to, a positive end of the flywheel unit D to form a flywheeling path for the current of the inductance L. A current detecting resistance Ri is coupled to the other end of the inductance L and the ground, and generates a current detecting signal IFB representing an amount of the current flowing through the LED module 320.

The LED driving controller 300 includes a hysteresis comparator unit 302, a SR flip-flop 306, an inverter 304 and a current corrective unit 308. The current corrective unit 308 generates a reference signal Vr according to the current detecting signal IFB. The hysteresis comparator unit 302 generates a comparison result signal according to the current detecting signal IFB and the reference signal Vr. The current corrective unit 308 may generate two reference signals as hysteresis reference levels for different hysteresis comparator unit 302 which needs two reference level to perform the operation of hysteresis comparing. In the present embodiment, the hysteresis comparator unit 302 determines higher and lower hysteresis level according to the reference signal Vr and a hysteresis range. Thus, the current of the inductance L is vibrated with a current range above zero, i.e., the inductance L is operated in the continuous current mode. The current corrective unit 308 may be an error amplifier. In the present embodiment, take an integral circuit as the current corrective unit 308 to determine the average value of the current for example. The current corrective unit 308 described below also be applied to the two embodiments mentioned above for replacing the error amplifier.

The current corrective unit 308, comprising a comparator 301, a charging unit, a discharge unit and an integral unit 303, is utilized for generating the reference signal Vr. The integral unit 303 may be a capacitance or a circuit with integral function. The charging unit has a first current source I1, which is coupled to the integral unit 303, utilized to supply a basic charging current charging for the integral unit 303. The discharge unit has a second current source I2 and a switch 305. The second current source I2 is coupled to the integral unit 303 through the switch 305, and provides a discharge current for discharging the integral unit 303. Wherein, the current of the first current source I1 is smaller than the current of the second current source I2. An inverting end of the comparator 301 receives a reference basic signal Vr', and a non-inverting end thereof receives the current detecting signal IFB. Accordingly, the comparator 301 controls the switch 305 to be turned on/off. When a level of the current detecting signal IFB is lower than that of the reference basic signal Vr', the comparator 301 outputs a low-level signal to turn the switch 305 off. At this time, the integral unit 303 is charged by the first current source I1 to increase a voltage of the integral unit 303. When the level of the current detecting signal IFB is higher than the level of the reference basic signal Vr', the comparator 301 outputs a high-level signal to turn on the switch 305 and so the second current source I2 discharges the integral unit 303. Because the current of the first current source I1 is smaller than the current of the second current source I2, the voltage of the integral unit 303 is reduced. Thus, when the average value of the current detecting signal IFB is higher than the reference basic signal Vr', the current corrective unit 308 lowers the level of the reference signal Vr. On the other hand, when the average value of the current detecting signal IFB is lower than the reference basic signal Vr', the current corrective unit 308 increases the level of the reference signal Vr. The hysteresis comparator unit 302 receives the current detecting signal IFB and the reference signal Vr to accordingly generate a comparison result signal. A set end S of the SR flip-flop 306 is coupled to an output end of the hysteresis comparator unit 302, and a reset end R of the SR flip-flop 306 is coupled to the output end of the hysteresis comparator unit 302 through the inverter 304. An output end Q of the SR flip-flop 306 is coupled to a controlled end of the switch module SW. At the beginning of each cycle, the current of the LED module 320 is lower and so the hysteresis comparator unit 302 generates a high-level signal. At this time, the output end Q of the SR flip-flop 306 generates a high-level signal to turn the switch module SW on. Then, an increasing current of the input power source Vin flows through the switch module SW, the LED module 320, the inductance L, the current detecting resistance Ri to the ground. When the current of the LED module 320 increases to cause the hysteresis comparator unit 302 generating a low-level signal, the SR flip-flop 306 turns the switch module SW off and the current of the inductance L freewheels through the flywheel unit D. On the other hand, when the current of the LED module 320 decreases to cause the hysteresis comparator unit 302 generating the high-level signal, the SR flip-flop 306 turns the switch module SW on again for next cycle.

The current corrective unit 308 may be applied to the LED driving controller 100 shown in FIG. 2 to generate the reference signal Vr received by the comparator unit 102 to replace the current corrective unit 108. Therefore, the LED driving controller 100 with the current corrective unit 308 can stabilize the average value of the current flowing through the LED module 120 substantially at the predetermined current value by adjusting the reference signal Vr. Similarly, the current corrective unit 308 may be applied to the LED driving controller 200 shown in FIG. 3 to generate the reference signal Vr received by the comparator unit 202 to replace the current corrective unit 208 for stabilizing the average value of the current flowing through the LED module 220 substantially at the predetermined current value.

While the preferred embodiments of the present invention have been set forth for the purpose of disclosure, modifications of the disclosed embodiments of the present invention as well as other embodiments thereof may occur to those skilled in the art. Accordingly, the appended claims are intended to cover all embodiments which do not depart from the spirit and scope of the present invention.

What is claimed is:

1. An LED driving controller, utilized for controlling a switching converter circuit to supply a driving power to an LED module, the LED driving controller comprising:

a comparator unit, directly receiving a current detecting signal and a reference signal representing a predetermined current value, and generating a comparison result signal according to the reference signal and the current detecting signal representing an amount of a current flowing through the LED module;

a switch control unit, generating a switch control signal according to the comparison result signal and a predetermined time period to control a switch module of the switching converter circuit; and a current corrective unit, directly receiving the current detecting signal and the reference signal to determine a difference between the predetermined current value and an average value of the current flowing through the LED module and accordingly generating a current corrective signal to adjust the predetermined time period, thereby stabilize the average value of the current flowing through the LED module at the predetermined current value, wherein the average value of the current flowing through the LED module is determined by integrating the current detecting signal.

2. The LED driving controller of claim 1, wherein the switch control unit includes a constant time generator unit, which generating a constant time signal representing the predetermined time period, in which a generating sequence of the constant time signal is determined according to the comparison result signal.

3. The LED driving controller of claim 2, wherein the current corrective unit includes an error amplifier, which generates an error amplified signal according to the current detecting signal and a reference signal, wherein the constant time generator unit adjusts the predetermined time period according to the error amplified signal.

4. The LED driving controller of claim 1, wherein the current corrective unit includes a capacitor, which generates the current corrective signal by integration in response to the current detecting signal.

5. An LED driving controller, utilized for controlling a switching converter circuit to supply a driving power to an LED module, the LED driving controller comprising:

a current corrective unit, directly receiving a current detecting signal and generating at least a reference signal according to the current detecting signal representing an amount of a current flowing through the LED module, wherein the current corrective unit further comprises:

an error comparator, receiving the current detecting signal and a current reference signal to output a result signal;

a capacitor, utilized for providing the at least a reference signal;

a charging unit, coupled to the capacitor and utilized to supply a basic charging current for charging the capacitor; and a discharge unit, selectively coupled to the capacitor in response to level of the result signal and utilized to supply a discharge current for discharging the capacitor when coupled to the capacitor, the basic charging current is smaller than the discharge current, wherein a level of the reference signal is varied in response to the result signal;

a comparator unit, directly receiving the current detecting signal and the at least a reference signal and generating a comparison result signal according to the current detecting signal and the least a reference signal; and a switch control unit, generating a switch control signal in response to the comparison result signal to control a switch module of the switching converter circuit.

6. The LED driving controller of claim 5, wherein the comparator unit is a hysteresis comparator unit.

7. The LED driving controller of claim 5, wherein the switch control unit generates the switch control signal further according to a predetermined time period to control the switch module of the switching converter circuit.

8. An LED driving circuit, comprising:

an LED module;

an inductance, coupled to one end of the LED module;

a diode, coupled to the LED module and the inductance, for providing a current loop;

a switch module, coupled to the LED module for controlling a power from an input power source whether to supply to the LED module or not; and an LED driving controller as claimed in claim 5, utilized for cyclically turning the switch module on or off for a predetermined time period in response to a current detecting signal representing an amount of a current flowing through the LED module, wherein the LED driving controller adjusts the predetermined time period according to a difference between an average value of a current flowing through the LED module and a predetermined current value , so as to substantially stabilize the average value of the current flowing through the LED module at the predetermined current value.

9. The LED driving controller of claim 8, wherein the inductance is operated in the continuous current mode.

* * * * *